US012398959B2

(12) United States Patent
Chen et al.

(10) Patent No.: US 12,398,959 B2
(45) Date of Patent: Aug. 26, 2025

(54) THERMAL MODULE

(71) Applicant: ASIA VITAL COMPONENTS CO., LTD., New Taipei (TW)

(72) Inventors: Chih-Peng Chen, New Taipei (TW); Han-Min Liu, New Taipei (TW); Xing-Hui Li, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 211 days.

(21) Appl. No.: 18/064,286

(22) Filed: Dec. 12, 2022

(65) Prior Publication Data

US 2023/0243594 A1 Aug. 3, 2023

(30) Foreign Application Priority Data

Jan. 28, 2022 (TW) ..... 111103922

(51) Int. Cl.
*F28D 15/02* (2006.01)
*F28F 1/32* (2006.01)

(52) U.S. Cl.
CPC ..... *F28D 15/0275* (2013.01); *F28F 1/325* (2013.01); *F28F 2275/06* (2013.01)

(58) Field of Classification Search
CPC .. F28D 15/0275; F28D 15/0233; F28F 1/325; F28F 2275/06
See application file for complete search history.

(56) References Cited

U.S. PATENT DOCUMENTS 6,625,021 B1 * 9/2003 Lofland ..... H01L 23/427 361/720
6,779,595 B1 * 8/2004 Chiang ..... H01L 23/467 165/185

(Continued)

FOREIGN PATENT DOCUMENTS

CN 1332475 A 1/2002
CN 100343611 C 10/2007

(Continued)

OTHER PUBLICATIONS

Search Report dated Oct. 25, 2022 issued by Taiwan Intellectual Property Office for counterpart application No. 109103570.

(Continued)

*Primary Examiner* — Len Tran
*Assistant Examiner* — Gustavo A Hincapie Serna
(74) *Attorney, Agent, or Firm* — Bradley J. Thorson; DeWitt LLP

(57) ABSTRACT

A thermal module includes a copper base seat, at least one U-shaped aluminum heat pipe, an aluminum radiating fin assembly and a copper embedding layer. The copper base seat has a heat absorption side and a heat conduction side. The heat absorption side or the heat conduction side is recessed to form at least one first heat pipe receiving channel. The U-shaped aluminum heat pipe has a horizontal section as a heat absorption section and two vertical sections as condensation sections. The heat absorption section is positioned in the first heat pipe receiving channel. The aluminum radiating fin assembly has multiple radiating fins. The copper embedding layer is disposed on a surface of the heat absorption section of the U-shaped aluminum heat pipe. By means of the copper embedding layer, two different materials can be directly welded.

3 Claims, 3 Drawing Sheets

(56) References Cited

U.S. PATENT DOCUMENTS 7,277,287 B2 * 10/2007 Chen ..... H01L 23/427 165/80.4
8,267,157 B2 * 9/2012 Qin ..... F28D 15/0275 165/104.33
9,405,336 B1 * 8/2016 Li ..... G06F 1/186
10,108,237 B1 * 10/2018 Fu ..... F28D 15/0275
10,739,832 B2 * 8/2020 O'Connell ..... H01L 23/467
2005/0201059 A1 * 9/2005 Lin ..... G06F 1/20 361/700
2006/0181848 A1 * 8/2006 Kiley ..... F28D 15/0275 361/709
2006/0291166 A1 * 12/2006 Cheng ..... F28F 3/048 257/E23.099
2007/0029072 A1 * 2/2007 Lee ..... H01L 23/427 257/E23.099
2007/0144710 A1 * 6/2007 Cheng ..... F28D 15/0275 257/E23.099
2007/0215328 A1 * 9/2007 Hsu ..... H01L 23/427 257/E23.106
2009/0025909 A1 * 1/2009 Huang ..... F28D 15/0233 165/104.26
2009/0097265 A1 * 4/2009 Sun ..... F21V 29/763 362/373
2009/0178787 A1 * 7/2009 Huang ..... H01L 23/427 165/104.33
2009/0288294 A1 * 11/2009 Feng ..... F28F 1/24 29/890.032
2010/0236754 A1 * 9/2010 Liu ..... A61P 3/10 165/104.33
2010/0270007 A1 * 10/2010 Lin ..... F28D 15/0233 165/80.2
2010/0307728 A1 * 12/2010 Lian ..... H01L 23/3672 165/181
2011/0100610 A1 * 5/2011 Chao ..... F28F 1/32 165/104.34
2011/0108244 A1 * 5/2011 Anzai ..... H01L 23/427 165/104.26
2011/0277977 A1 * 11/2011 Lin ..... F28F 1/006 165/181
2012/0305221 A1 * 12/2012 Huang ..... F28D 15/0275 165/185
2013/0180688 A1 * 7/2013 Lin ..... B22D 19/0081 164/112
2013/0255929 A1 * 10/2013 Chen ..... H01L 21/4878 165/185
2014/0076521 A1 * 3/2014 Lin ..... F28D 15/0275 165/104.21
2016/0126602 A1 * 5/2016 Walser ..... H01M 10/613 429/120
2017/0102186 A1 * 4/2017 Huang ..... F28D 15/0275
2017/0284738 A1 * 10/2017 Watanabe ..... F28D 15/0275
2018/0080717 A1 * 3/2018 Kawabata ..... F28D 15/0275
2018/0235070 A1 * 8/2018 Brocklesby ..... G06F 1/20
2020/0240716 A1 * 7/2020 Watanabe ..... G21K 5/00
2020/0383232 A1 * 12/2020 Gary ..... H01L 23/367
2021/0105913 A1 * 4/2021 Au ..... F28F 27/00
2023/0037056 A1 * 2/2023 Wang ..... B23K 31/02
2024/0284637 A1 * 8/2024 Inagaki ..... F28D 15/0275

FOREIGN PATENT DOCUMENTS

CN 101408302 A 4/2009
CN 101896049 A 11/2010
CN 202485510 U 10/2012
CN 216820488 U 6/2022
TW M310370 U * 4/2007
TW 200725234 A 7/2007
TW 201038911 A 11/2010
TW 201723413 A 7/2017
TW M627851 U 6/2022
WO WO-2011035526 A1 * 3/2011 ..... F21V 29/74
WO WO-2018214096 A1 * 11/2018 ..... G06F 1/20

OTHER PUBLICATIONS

Search Report dated Jun. 20, 2024 issued by China National Intellectual Property Administration for counterpart application No. 2022101044764.
Search Report dated Oct. 25, 2022 issued by Taiwan Intellectual Property Office for counterpart application No. 109103570, 2 pages.

* cited by examiner

THERMAL MODULE

This application claims the priority benefit of Taiwan patent application number 111103922 filed on Jan. 28, 2022.

BACKGROUND OF THE INVENTION

1. Field of the Invention

The present invention relates generally to a thermal module, and more particularly to a thermal module, which improves the problem of the conventional thermal module that the respective heat dissipation components of the thermal module can be hardly welded and connected with each other.

2. Description of the Related Art

Copper has the property of high heat conductivity. Therefore, the conventional thermal module structure often employs copper base seat for directly contacting a heat source to absorb the heat generated by the heat source. The copper base seat then transfers the absorbed heat to the heat pipe for speeding heat conduction and radiating fins for increasing heat dissipation area and enhancing heat dissipation efficiency. However, the thermal module employing the copper-made base seat and the copper-made heat pipe as well as the radiating fins has relatively heavy total weight. Also, the cost for the copper material is higher. Therefore, in recent years, the copper radiating fins and copper base seat have been gradually replaced with lightweight aluminum radiating fins and aluminum base seat of lower cost.

The copper material is replaced with the aluminum material to improve the problems of heavy weight and high material cost of the conventional thermal module. However, the aluminum material also has some shortcomings. For example, the surface of the aluminum is easy to oxidize to produce oxide of high melting point in the welding process. Under such circumstance, it is hard to fully fuse the metal at the welding seam. Therefore, it is difficult to weld the aluminum material.

In the case that the copper material is directly welded with the aluminum material, after welded, the directly mated sections of these two materials are apt to fissure due to fragility. In addition, when the copper material is fused and welded with the aluminum material, eutectic structures such as $CuAl_2$ are quite easy to form in the welding seam near the copper material side. The eutectic structures of $CuAl_2$, etc. are simply distributed over the grain boundaries of the material and easy to cause fatigue or fissure between the grain boundaries. Moreover, the melting point temperature and eutectic temperature of copper and aluminum are greatly different from each other. Therefore, in the welding operation, when aluminum is molten, the copper still keeps in solid state. When copper is molten, too much aluminum has been molten so that they cannot coexist in a co-fused or eutectic state. This increases difficulty in welding. Furthermore, pores are easy to produce at the welding seam. This is because the copper and aluminum both have very good heat conductivity. When welded, the metal in the molten pool will quickly crystallize. As a result, the metallurgy reaction gas at high temperature cannot escape in time so that pores are easy to produce. Accordingly, copper material and aluminum material cannot be directly welded with each other. It is necessary to first modify the surface of the aluminum material for successive welding operation with the copper material or other materials. In order to improve the above shortcoming that the copper material is placed with the aluminum material, while the aluminum material cannot be directly welded with the copper material or other heterogeneous material, those who are skilled in this field employ electroless nickel plating as a technique for modifying the surface of the aluminum material. The electroless nickel plating can be classified into three types: low phosphorus, middle phosphorus and high phosphorus. The electroless deposition is also termed "chemical deposition" or "autocatalytic plating". The electroless nickel plating solution can be classified into the following three types: (1) activate/sensitize+acidic plating bath, pertaining to acidic plating solution with a pH value within 4~6. The property of such acidic plating solution is that the loss of composition amount due to the evaporation amount is less. The operation temperature is higher, but the plating solution is relatively safe and easy to control. The plating solution has high phosphorus content and high plating ratio and is often used in industrial field. (2) activate/sensitize+alkaline plating bath, pertaining to alkaline plating solution with a pH value within 8~10. The ammonia for adjusting pH value is easy to volatilize so that in operation, it is necessary supplement ammonia at proper time so as to keep the pH value stable. The plating solution has less phosphorus content and is relatively unstable and the operation temperature of the plating solution is lower. (3) HPM+alkaline plating bath. HPM is such that the silicon crystal is soaked in a mixture solution of DI-water:$H_2O_2$(aq):HCl(aq)=4:1:1. The oxidized layer formed on the surface of the silicon crystal substitutes for the activate/sensitize to form an autocatalytic surface on the surface.

It is necessary to use a great amount of chemical reaction liquid in the electroless nickel plating process. In addition, after the electroless nickel plating process, a great amount of industrial waste liquid containing heavy metal or chemical material will be produced. Such industrial waste liquid will produce a great amount of waste water containing toxic material such as yellow phosphorus. The waste water cannot be repeatedly used and must be recovered and treated through a dedicated unit. The waste water cannot be directly discharged so as to avoid environmental pollution. The yellow phosphorus waste water contains yellow phosphorus of a concentration ranging from 50 mg/L to 390 mg/L. Yellow phosphorus is a hypertoxic material and is greatly harmful to the organs of human body, such as the liver. After a long period of drinking water containing yellow phosphorus, a human will suffer from the lesions of osteoporosis, necrosis of mandibular bone, etc. Therefore, currently, all countries have started to prohibit such manufacturing process and promoted non-toxic manufacturing process so as to protect the environment.

It is therefore tried by the applicant to provide a thermal module, in which the total weight of the structure is reduced and the chemical nickel plating is replaced with copper embedding layer as a surface modifying method for improving the problem of the conventional thermal module that the aluminum material cannot be directly welded with other heterogeneous material. Also, the thermal module of the present invention can facilitate the welding operation without additionally producing any pollutant to pollute the environment.

SUMMARY OF THE INVENTION

It is therefore a primary object of the present invention to provide a thermal module, in which the chemical nickel plating is replaced with copper embedding layer to improve the problem of the conventional thermal module that the aluminum-made heat dissipation component cannot be directly welded with other heterogeneous material-made heat dissipation component.

To achieve the above and other objects, the thermal module of the present invention includes a copper base seat, at least one U-shaped aluminum heat pipe, an aluminum radiating fin assembly and a copper embedding layer. The copper base seat has a heat absorption side and a heat conduction side. Any or both of the heat absorption side and the heat conduction side are recessed to form at least one first heat pipe receiving channel. The U-shaped aluminum heat pipe has a horizontal section as a heat absorption section and two vertical sections as condensation sections. The heat absorption section is positioned in the first heat pipe receiving channel. The aluminum radiating fin assembly has multiple radiating fins. A heat dissipation flow way is defined between each two adjacent radiating fins. The heat dissipation flow way is in parallel to the heat conduction side of the copper base seat. The condensation sections are passed through the radiating fins. The copper embedding layer is disposed on a surface of the heat absorption section, whereby the copper base seat can be directly welded with the U-shaped aluminum heat pipe.

The present invention employs the copper embedding layer instead of chemical nickel plating. The copper embedding layer is disposed on the surface of a section of the aluminum-made heat dissipation component, which section is to be connected with the other component. When the aluminum-made heat dissipation component is desired to be welded with other heterogeneous material-made heat dissipation component, the copper embedding layer improves the problem that the aluminum-made heat conduction/dissipation components can be hardly welded with each other. The conventional chemical nickel coating is replaced with copper embedding layer so that the problem caused by the chemical nickel plating can be improved. Moreover, the copper pipe is replaced with the aluminum pipe so that the total weight of the thermal module is greatly reduced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
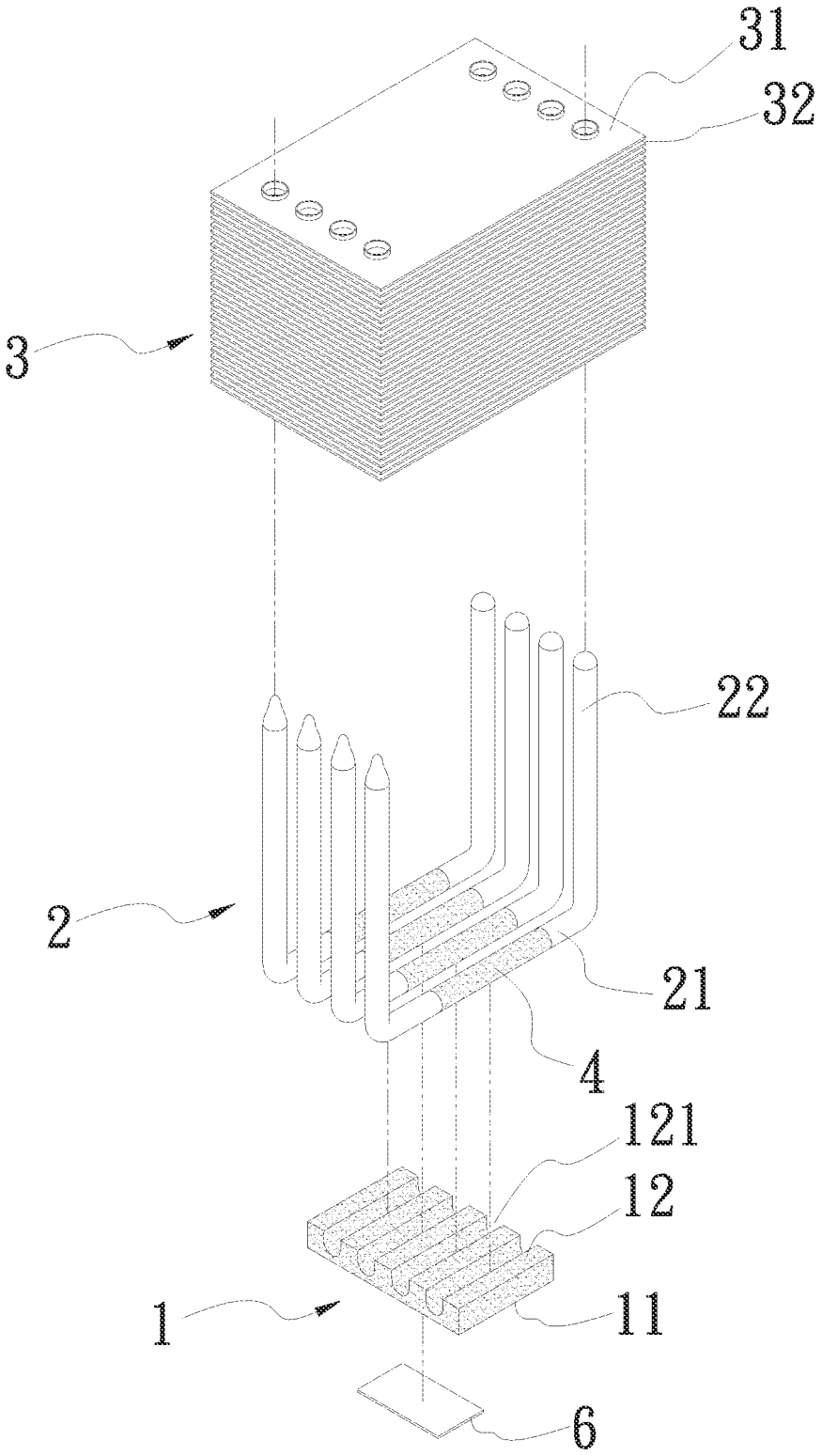
FIG. 1 is a perspective exploded view of a first embodiment of the thermal module of the present invention.
Figure 2:
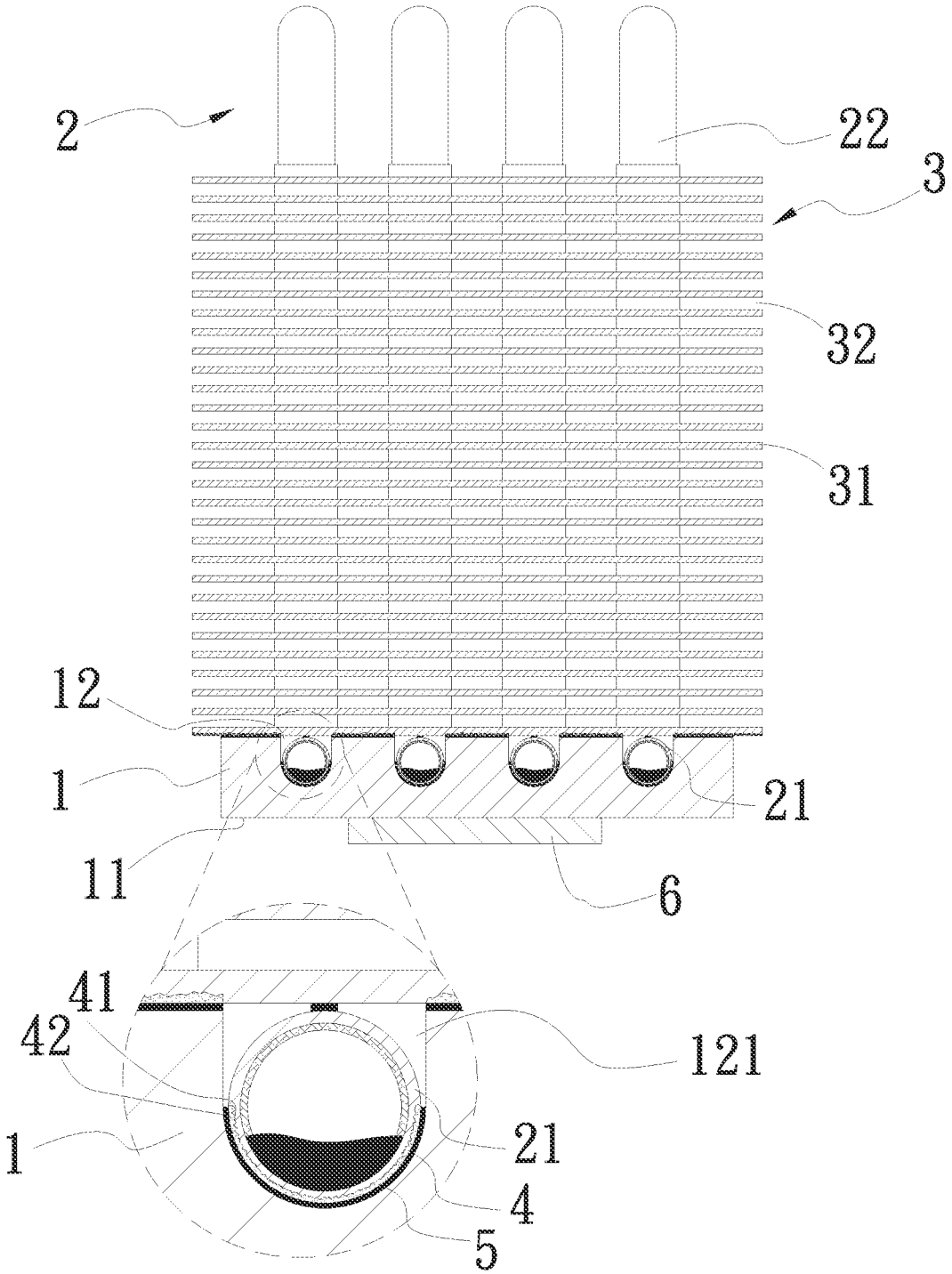
FIG. 2 is a sectional assembled view of the first embodiment of the thermal module of the present invention.

Please refer to FIGS. 1 and 2. FIG. 1 is a perspective exploded view of a first embodiment of the thermal module of the present invention. FIG. 2 is a sectional assembled view of the first embodiment of the thermal module of the present invention. As shown in the drawings, the thermal module of the present invention includes a copper base seat 1, at least one U-shaped aluminum heat pipe 2, an aluminum radiating fin assembly 3 and a copper embedding layer 4.

The copper base seat 1 has an upper side and a lower side respectively having a heat conduction side 12 and a heat absorption side 11. The heat absorption side 11 is correspondingly attached to and assembled with at least one heat source 6 to absorb and conduct the heat of the heat source 6. The heat conduction side 12 is disposed on the copper base seat 1 opposite to the heat absorption side 11. Any or both of the heat absorption side 11 and the heat conduction side 12 are recessed to form at least one first heat pipe receiving channel 121. In this embodiment, the first heat pipe receiving channel 121 is, but not limited to, disposed on the heat conduction side 12 for illustration purpose.

The U-shaped aluminum heat pipe 2 has a horizontal section and two vertical sections connected with two ends of the horizontal section. A heat absorption section 21 is disposed on the horizontal section, while a condensation section 22 is disposed on the vertical sections. The heat absorption section 21 is positioned in the first heat pipe receiving channel 121 of the copper base seat 1.

The aluminum radiating fin assembly 3 has multiple radiating fins 31. The radiating fins 31 are side by side arranged in parallel to each other. At least one heat dissipation flow way 32 is defined between each two adjacent radiating fins 31. The heat dissipation flow way 32 is in parallel to the heat conduction side 12 of the copper base seat 1. The condensation section 22 of the U-shaped aluminum heat pipe 2 is passed through the radiating fins 31 and connected therewith. The radiating fins 31 and the condensation section 22 of the U-shaped aluminum heat pipe 2 are connected with each other by means of press fit or welding.

Figure 3:
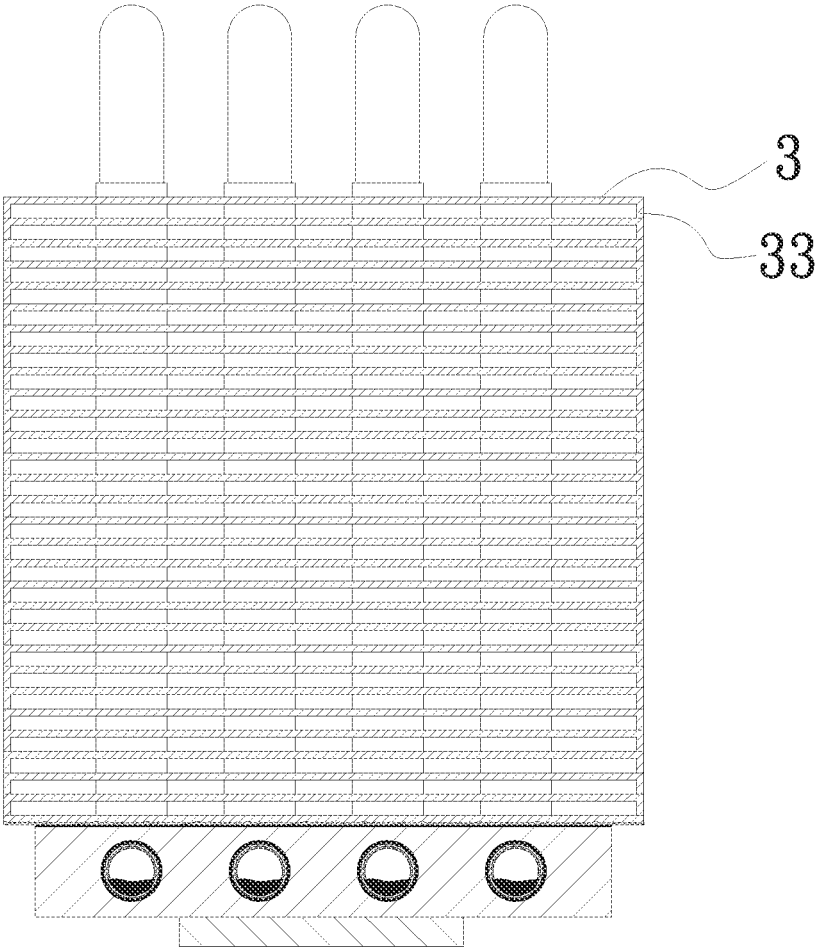
FIG. 3 is another sectional assembled view of the first embodiment of the thermal module of the present invention.

Please refer to FIG. 3, which is another sectional assembled view of the first embodiment of the thermal module of the present invention, showing a modified embodiment of the aluminum radiating fin assembly. Each of the radiating fins 31 of the aluminum radiating fin assembly 3 has at least one folding edge 33. The folding edges 33 of the radiating fins 31 are connected with each other by means of lap joint so as to assemble the radiating fins 31 with each other.

The copper embedding layer 4 is disposed on the surface of the heat absorption section 21 of the U-shaped aluminum heat pipe 2. The copper embedding layer 4 has an embedding face 41 and a contact face 42 respectively positioned on two opposite faces of the copper embedding layer 4. The embedding face 41 is inlaid in the surface of the heat absorption section 21 of the U-shaped aluminum heat pipe 2. The contact face 42 serves as an exposed surface of the copper embedding layer 4 and is connected with a welding material layer 5. By means of the copper embedding layer 4, the non-copper-made U-shaped aluminum heat pipe 2 and the non-copper-made aluminum radiating fin assembly 3 can be successfully, directly and securely connected with the copper base seat 1. Alternatively, by means of the welding material layer 5, the connection effect between the copper base seat 1 and the U-shaped aluminum heat pipe 2 can be enhanced.

Alternatively, a second heat pipe receiving channel can be disposed on the copper base seat 1. The first heat pipe receiving channel is disposed on the copper base seat 1 and transversely extends. The second heat pipe receiving channel is disposed on the copper base seat 1 and longitudinally extends. The first heat pipe receiving channel 121 is disposed under the second heat pipe receiving channel. The first and second heat pipe receiving channels 121 transversely and longitudinally intersect each other.

The second heat pipe receiving channel enables more U-shaped aluminum heat pipes 2 to be arranged on the copper base seat 1. In this embodiment, the U-shaped aluminum heat pipes 2 are divided into two sets. One of the two sets is first U-shaped aluminum heat pipe 2*a* disposed in the first heat pipe receiving channel 121, while the other of the two sets is second U-shaped aluminum heat pipe disposed in the second heat pipe receiving channel. The second U-shaped aluminum heat pipe is disposed above the first U-shaped aluminum heat pipe 2*a* to longitudinally overlap and intersect the first U-shaped aluminum heat pipe 2*a* for longitudinally conducting the heat of the copper base seat 1. Accordingly, more room per unit volume is provided for arranging more heat pipes. The copper embedding layer 4 is disposed on the heat absorption sections 21 of the first and second U-shaped aluminum heat pipes 2*a*, whereby the first and second U-shaped aluminum heat pipes 2*a* can be correspondingly directly connected with the first and second heat pipe receiving channels 121 by means of welding. Also, by means of the copper embedding layer 4 disposed on the first and second U-shaped aluminum heat pipes 2*a*, the transversely and longitudinally intersecting and overlapping sections of the first and second U-shaped aluminum heat pipes 2*a* can be directly welded with each other to enhance the connection thereof.

In addition, the copper embedding layer 4 is embedded in the surfaces of the first and second U-shaped aluminum heat pipes 2*a* in such a manner that a copper layer is attached to the outer surface of a material to be welded with the copper material by means of mechanical processing. A copper sheet is attached to and overlaid on the outer side of a non-copper material to be welded with the copper material. Then, by means of mechanical processing of punching, hammering, impacting, rolling and embossing, the copper sheet intrudes the outer surface of the non-copper material under external force and is securely overlaid on the outer surface of the non-copper material. Alternatively, the copper embedding layer 4 can be formed on the outer surface of the non-copper material by means of electroplating or spraying to enhance the welding ability of the non-copper material with the copper material.

In manufacturing of the conventional thermal module, the copper base seat and the copper pipe and the aluminum radiating fins are connected with each other. The copper material has better heat conduction efficiency. However, the total weight of the thermal module is quite heavy. In addition, the cost for the copper material is very high. Also, the copper pipe and the aluminum radiating fins must be connected by means of welding. However, the copper material cannot be directly welded with the aluminum material. It is necessary to first deposit a nickel coating on the section of the radiating fins, which section is to be connected with the copper base seat, by means of chemical nickel deposition so that the copper heat pipe and the aluminum radiating fins can be successfully welded and connected. The environmental pollution caused by the process of chemical nickel deposition has been gradually stressed and required to improve. Therefore, the present invention provides a thermal module, in which the copper heat pipe is replaced with aluminum heat pipe so as to reduce the total weight of the thermal module. In addition, a copper embedding layer is applied to the surface of the connected sections of the aluminum heat pipe, the aluminum radiating fins and the copper base seat, whereby the aluminum heat pipe, the aluminum radiating fins and the copper base seat can be welded and connected with each other. The present invention employs the copper embedding layer instead of the chemical electroplated nickel so as to improve the problems of the conventional thermal module that the weight is too heavy and the copper material and the aluminum heat dissipation/conduction components cannot be directly welded with each other.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A thermal module comprising:

a copper base seat having a heat absorption side and a heat conduction side, any or both of the heat absorption side and the heat conduction side being recessed to form at least one first heat pipe receiving channel;

at least one U-shaped aluminum heat pipe having a horizontal section as a heat absorption section and two vertical sections as condensation sections, the heat absorption section being positioned in the first heat pipe receiving channel;

an aluminum radiating fin assembly having multiple radiating fins, at least one heat dissipation flow way being defined between each two adjacent radiating fins, the heat dissipation flow way being in parallel to the heat conduction side of the copper base seat, the condensation sections being passed through the radiating fins and connected therewith; and a copper embedding layer being disposed on a surface of the heat absorption section of the U-shaped aluminum heat pipe, wherein the copper embedding layer has an embedding face and a contact face respectively positioned on two opposite faces of the copper embedding layer, the embedding face being inlaid in the surface of the heat absorption section of the U-shaped aluminum heat pipe, the contact face serving as an exposed surface of the copper embedding layer and being connected with a welding material layer, whereby the copper base seat can be directly welded with the U-shaped aluminum heat pipe, and the welding material layer is directly connecting the copper base seat and the U-shaped aluminum heat pipe, and the copper embedding layer is directly arranged between the heat absorption section and the copper base seat.

2. The thermal module as claimed in claim 1, wherein the radiating fins and the condensation sections of the U-shaped aluminum heat pipe are connected with each other by means of welding.

3. The thermal module as claimed in claim 1, wherein each of the radiating fins of the aluminum radiating fin assembly has at least one folding edge, the folding edges of the radiating fins being connected with each other by means of lap joint so as to assemble the radiating fins with each other.

* * * * *